United States Patent [19]

Steele et al.

[11] Patent Number: 4,508,235

[45] Date of Patent: Apr. 2, 1985

[54] BEVERAGE CUP COVER

[75] Inventors: Edward J. Steele, Mission Viejo; Rodney N. Sexton, Laguna Hills, both of Calif.

[73] Assignee: Runglin Co. Inc., Culver City, Calif.

[21] Appl. No.: 558,805

[22] Filed: Dec. 7, 1983

[51] Int. Cl.[3] ..... B65D 51/16

[52] U.S. Cl. ..... 215/307; 220/306; 220/254; 220/90.4; 229/43

[58] Field of Search ..... 215/307, 310, DIG. 7; 220/90.4, 306, 356, 254; 229/43

[56] References Cited

U.S. PATENT DOCUMENTS

| | | | |
|---|---|---|---|
| 2,071,700 | 2/1937 | McPhail | 220/254 X |
| 3,048,317 | 8/1962 | Cochrane et al. | 220/254 X |
| 3,307,602 | 3/1967 | Boster | 220/254 X |
| 3,592,353 | 7/1971 | Bowen | 220/254 |
| 3,760,972 | 9/1973 | McKirnan | 220/254 X |
| 3,912,118 | 10/1975 | Bird | 229/43 X |
| 4,438,865 | 3/1984 | Scattaregia | 220/90.4 X |

*Primary Examiner*—Steven M. Pollard
*Attorney, Agent, or Firm*—John E. Kelly

[57] ABSTRACT

A hemispherically shaped cover is provided for a beverage cup and includes a top opening smaller than the normal opening of the cup itself. Beverage can be received through this top opening to fill the cup, the cover itself inhibiting spilling of the beverage over the upper rim of the cup. The same top opening is also used to receive a straw and permit a person to drink the beverage without having to remove the cover.

4 Claims, 3 Drawing Figures

BEVERAGE CUP COVER

FIELD OF THE INVENTION

This invention relates generally to drinking containers for beverages and more particularly to a specially constructed cover for a beverage cup.

BACKGROUND OF THE INVENTION

Many beverages sold today at amusement parks, by street vendors and in drugstores utilize crushed ice in combination with other ingredients providing a flavorful drink. In other instances, the beverage might include soda water, sparkling water, or equivalent fizzy mediums which cause generation of foam or a "head". Often when a beverage is rapidly mixed, a foamy type "head" will develop.

While such "foamy heads" are fairly cohesive, where crushed ice forms a part of the foamy beverage, the substance will invariably spill over the rim of the cup. It is difficult to control this spillage since the foamin action continues to occur even after the pouring of the beverage in the cup has stopped.

It would be very helpful if some means were available to inhibit such spillage of a beverage over the cup rim without appreciably adding to the cost of the beverage and without detracting from the overall appetizing appearance of the beverage in question.

BRIEF DESCRIPTION OF THE PRESENT INVENTION

With the foregoing in mind, the present invention contemplates the provision of a beverage cup cover which solves the foregoing problems.

More particularly, in its broadest aspect, the cover has a top opening of lesser size than the top of the cup so that a beverage received in the cup is prevented from spilling over the top rim of the cup. This top opening however, is sufficiently large that a straw can be easily inserted through the opening to permit a person to drink the beverage without having to remove the cover.

In the preferred embodiment, the cover is hemispherically shaped so as to permit foaming up action and is transparent so that the aesthetic appearance of the drink is not materially impaired.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
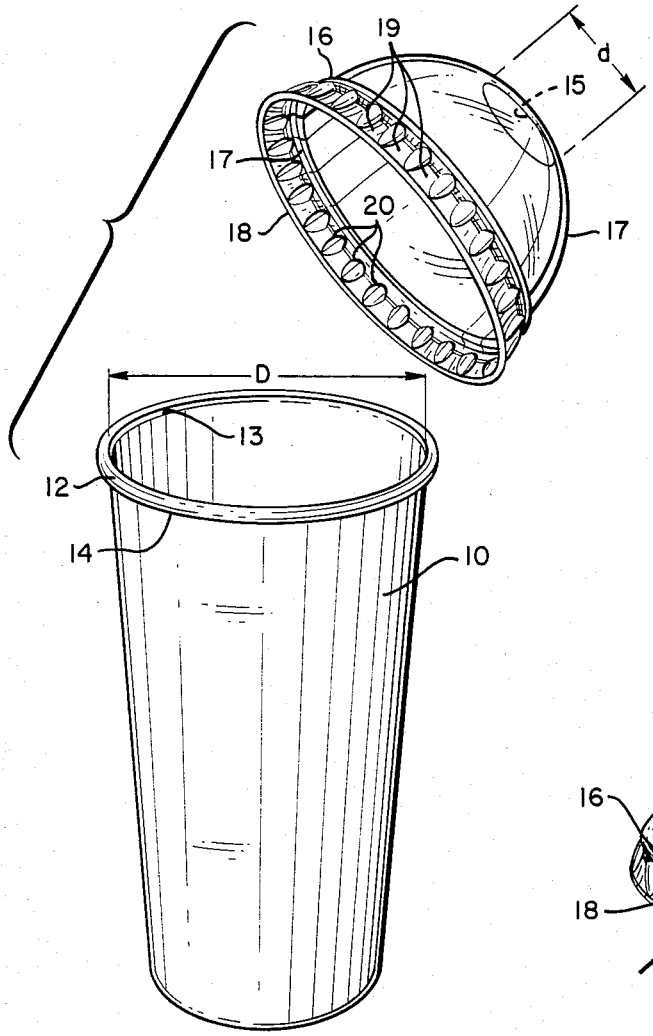
FIG. 1 is a perspective exploded view of the beverage cup cover of this invention preparatory to being inserted on the top of a beverage cup.

Referring first to FIG. 1, there is shown a beverage cup 10 and a cover 11 exploded away therefrom and constructed in accord with the present invention.

The cup 10 itself includes an integrally formed bead 12 extending radially beyond the top rim 13 of the cup wall to define an annular underledge 14. The significance of this underledge will become apparent as the description proceeds.

Referring to the cover 11, this cover is preferably of hemispherical shape and made of transparent plastic material. It includes a top opening 15 having a diameter less than ½ the diameter of the cup opening at the rim 13 of the cup shown. The diameter of this small opening is designated by the letter d while the cup opening diameter is designated by the letter D in FIG. 1.

The base of the hemispherically shaped cover 11 in turn, flares radially outwardly as indicated at 16 to define an annular surface 17 for seating on the top edge of the cup opening. This outwardly flaring portion of the base of the cup thence turns downwardly to define a skirt 18 dimensioned to overlie the bead 12 of the cup 10.

Figure 2:
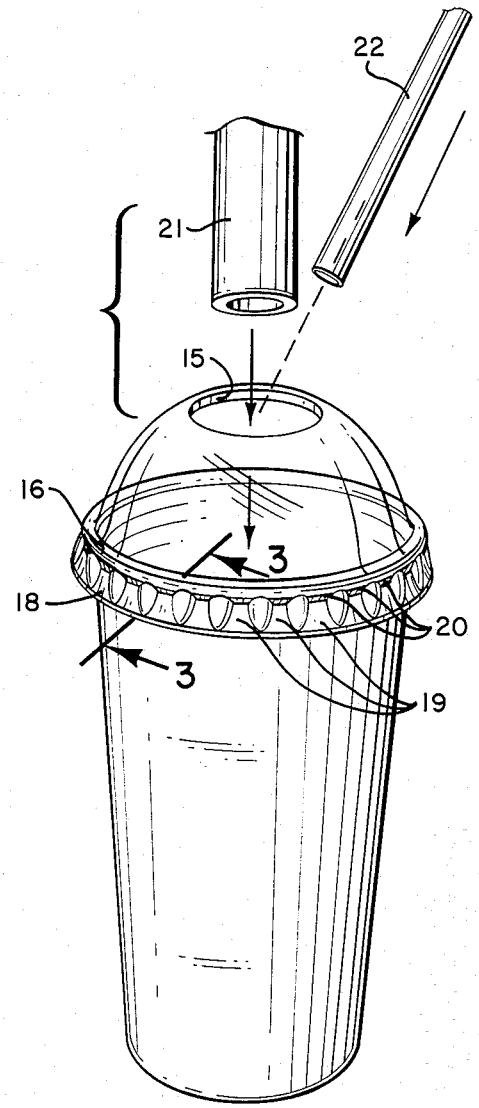
FIG. 2 is another perspective view of the cup and cover of FIG. 1 assembled together preparatory to receiving a beverage; and, FIG. 3 is a greatly enlarged fragmentary cross section taken in the direction of the arrows 3—3 of FIG. 2.

Referring particularly to FIG. 2, it will be noted that the side wall of the skirt has a series of uniformly circumferentially spaced inward radially directed indentations 19 over 360°. These indentations define upwardly facing segments 20 for engaging the annular underledge 14 of the cup bead 12 upon forcing the cover skirt over the annular bead to deform the indentations until they snap over the bead and the referred to upwardly facing segments 20 are free to engage under the annular underledge 14 upon return of the indentations to their original form.

Figure 3:
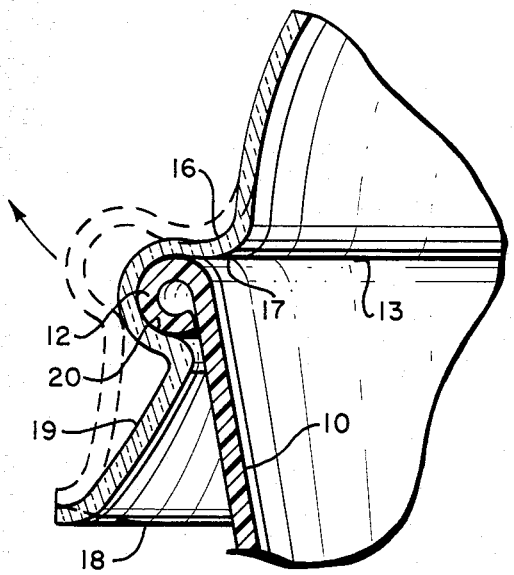

The foregoing action can best be visualized by referring to FIG. 3 which shows the initial deformation of the indentations such as the indentation 19 by the phantom or dotted line position as the cup cover is being positioned over the bead 12 of the cup. When the upwardly facing segments 20 pass over the bead 12, then the indentations 19 can return to their original form and the cover is held secure on the cup. It will be appreciated that where the cup comprises a thin plastic material, the deformations described can readily take place and there results a "snapping" type action to assure a user that the cup cover 11 is securely seated on the top of the cup 10.

Referring back to FIG. 2, there is indicated schematically at 21 a fill tube for dispensing a beverage directly through the top opening 15 of the cover into the cup. The beverage from the dispenser 21 might include a slurry of crushed ice with flavoring; different combinations of syrups, soda water, and the like, all of which can result in a foamy head on the beverage as the cup is being filled.

It will be appreciated from FIG. 2 that the cover 11 will permit upward foaming because of the hemispherical shape and yet prevent spillage over the rim of the cup.

The top opening 15 is sized to easily receive a drinking straw shown at 22 so that a user can drink from the cup without having to remove the cover 11.

From all of the foregoing, it will be evident that the present invention has provided a unique and useful beverage cup cover which will prevent spillage of foamy type drinks without detracting from the overall aesthetic appearance.

In the preferred embodiment, as described, the hemispherically shaped cover is made of plastic and can easily be economically manufactured and thus constitute a disposable item along with the cup itself when a person has finished drinking.

Changes falling within the scope and spirit of this invention will occur to those skilled in the art. The beverage cup cover is therefore not to be thought of as limited to the exact embodiment set forth merely for illustrative purposes.

We claim:

1. A beverage cup and cover combination in which:

(a) said cup has an upper rim in the form of an integral bead extending radially beyond the top edge of the cup wall to define an annular underledge; and (b) said cover is of hemispherical shape whose height is substantially one half its base including a top opening of diameter less than one half the diameter of the cup opening; the base of said hemispherical shape flaring radially outwardly to define an annular surface for seating on the top edge of said cup opening, and thence downwardly; to define a skirt dimensioned to overlie said bead; the side wall of said skirt having a series of uniformly circumferentially spaced inward radially directed indentations over 360°; said indentations defining upwardly facing segments for engaging under said annular underledge of said bead upon forcing the cover skirt over said annular bead to deform the indentations until they snap over the bead to said upwardly facing segments are free to engage under said annular underledge upon return of the indentations to their original form so that the cover is secured in plcae on said cup.

2. The subject matter of claim 1 in which said hemispherically shaped cover is transparent so that the contents of said cup are visible.

3. A beverage cup cover comprising:

(a) a cover base section of annular shape formed with interengaging means for use in holding the cover to the rim of a cup;

(b) a cover top section of hemispherical shape whose height is substantially one half the diameter of the base section, and, a top opening less than one half the diameter of the base section, (c) whereby when the cover is positioned on a cup, beverage dispensed into the cup through the top opening can generally rise to fill the cover top section without spilling over the cup or leaking beneath the cover base section, and, a straw can be inserted through the top opening without having to remove the cover.

4. The subject matter of claim 3 including a beverage cup and wherein:

the interengaging means includes an annular bead about the rim of said cup, and, inwardly radially directed indentations formed on the base section positioned to snap over said annular bead and hold the cover in place on said cup.

* * * * *